United States Patent [19]

Mori et al.

[11] 4,391,507

[45] Jul. 5, 1983

[54] COPYING MACHINE CONTROL APPARATUS COMPRISING VARIABLE LENGTH PROGRAM CONTROL

[75] Inventors: Goro Mori; Masaaki Ogura, both of Tokyo, Japan

[73] Assignee: Ricoh Company, Ltd., Tokyo, Japan

[21] Appl. No.: 240,658

[22] Filed: Mar. 5, 1981

[30] Foreign Application Priority Data

Mar. 13, 1980 [JP] Japan ..... 55-31764

[51] Int. Cl.[3] ..... G03G 15/00

[52] U.S. Cl. ..... 355/14 R

[58] Field of Search ..... 355/3 SH, 14 SH, 14 C, 355/14 R

[56] References Cited

U.S. PATENT DOCUMENTS 4,109,313 8/1978 Donohue et al. ..... 355/14 C X 4,139,300 2/1979 Katayama et al. ..... 355/14 R 4,215,931 8/1980 Tsuda et al. ..... 355/14 R

*Primary Examiner*—G. Z. Rubinson

*Assistant Examiner*—Keith E. George

*Attorney, Agent, or Firm*—David G. Alexander

[57] ABSTRACT

Timing pulses (TP) are generated in response to incremental rotation of a photoconductive drum (40). The pulses (TP) are counted by a presettable counter (10) and decoded to produce control signals ($STEP_n$) for scanning of an original document, sheet feed and other operations. When the count in the counter (10) reaches a certain value, the counter (10) is preset to a value depending on the paper size. A single control program is provided having a sequence of fixed program steps which are executed in response to respective counts in the counter (10). The smaller paper lengths are accommodated by programably presetting the counter (10) in such a manner as to skip unnecessary count sequences.

8 Claims, 7 Drawing Figures

FORMAT A4

FORMAT B4

COPYING MACHINE CONTROL APPARATUS COMPRISING VARIABLE LENGTH PROGRAM CONTROL

BACKGROUND OF THE INVENTION

The present invention relates to a control apparatus for a copying machine which employs counts of timing pulses appearing in synchronism with the rotation of a photosensitive drum to control the sequence of a copy process including charging, exposing, developing, transferring, fixing and sheet discharging steps.

Generally, a copying machine is furnished with various sizes or formats of transfer or copy sheets and causes a specific format of sheets conforming with the size of a document to be selected and processed by the machine.

With this in view, a copying machine usually performs sequence control of a copy process for the largest sheet format the machine can handle, regardless of the sheet format which was selected. For instance, where the largest usable format of sheets is A3, an optical scanning assembly of the machine will be moved a distance necessary for processing A3 sheets so as to scan a document even though the format of sheets actually used may be B5.

Such a sequence control, however, offers an obstruction to an increase in the operating speed of the machine or a decrease in the copying time.

A possible solution to this problem may be employing various kinds of sequence control programs for individual usable formats of sheets and selecting them in accordance with the format of sheets used. This is not acceptable, however, because a disproportionately large number of parts are needed which results in an increase in the cost.

SUMMARY OF THE INVENTION

A copying apparatus embodying the present invention comprises a moving photoconductive member, pulse generator means for producing pulses in response to incremental movements of the photoconductive member, presettable counter means for counting the pulses, decoder means for producing set output signals in response to predetermined counts in the counter means, and coder means constructed to apply a first output signal to the counter means when the count in the counter means has a first value and apply a second output signal to the counter means when the count in the counter means has a second value, the counter means being constructed to change its count from the first and second values to third and fourth values in response to the set output signals from the decoder means respectively.

In accordance with the present invention, timing pulses are generated in response to incremental rotation of a photoconductive drum. The pulses are counted by a presettable counter and decoded to produce control signals for scanning of an original document, sheet feed and other operations. When the count in the counter reaches a certain value, the counter is preset to a value depending on the paper size.

It is an object of the present invention to provide a copying machine control apparatus which shortens the copying time and cuts down the cost by causing sequence controls suited for individual formats of sheets to occur with a single control program. In order to achieve this object, a method according to the present invention allows the counts of timing pulses for sequence control of a copy process to partly skip or overlap in the course of a copy sequence.

It is another object of the present invention to provide a generally improved copying machine control apparatus.

Other objects, together with the foregoing, are attained to the embodiments described in the following description and illustrated in the accompanying drawing.

DESCRIPTION OF THE PREFERRED EMBODIMENTS

While the copying machine control apparatus of the present invention is susceptible of numerous physical embodiments, depending upon the environment and requirements of use, substantial numbers of the herein shown and described embodiments have been made, tested and used, and all have performed in an eminently satisfactory manner.

The present invention will be described with reference to the accompanying drawings.

Figure 1:
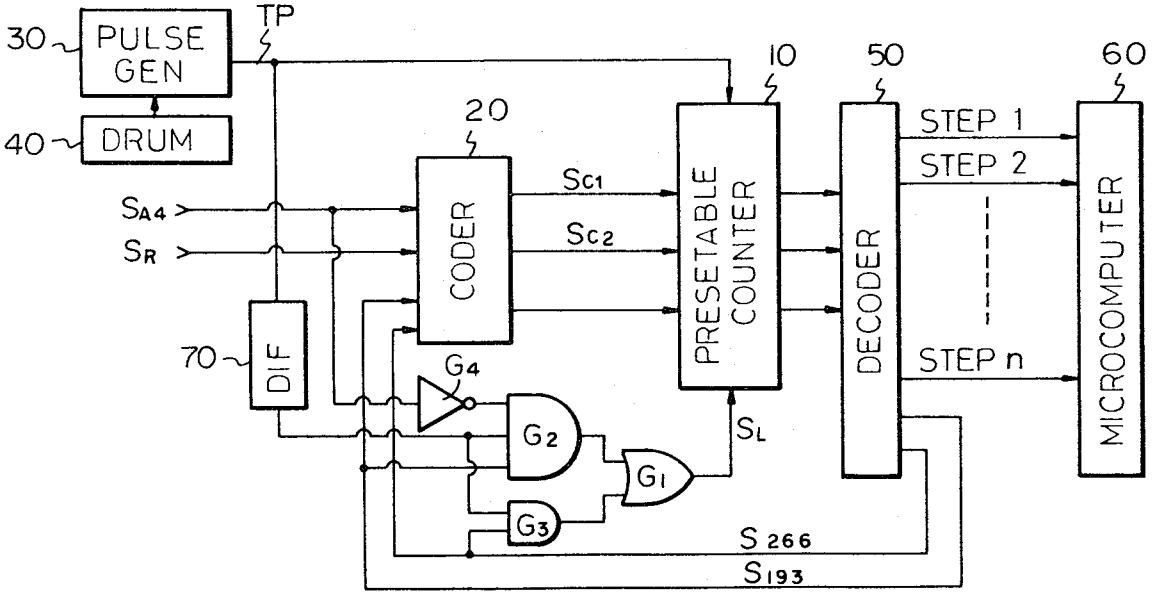
FIG. 1 is a block diagram of a copying machine control apparatus embodying the present invention.

Referring to FIG. 1, there is shown in block diagram form a control circuit for practicing a method of the present invention. The control circuit is designed for copying images on sheets of B4 and A4 formats using a sequence for processing sheets of B4 format by way of example.

As shown, the control circuit includes a presettable counter 10 which can be preset to any count in response to signals applied thereto externally. Timing pulses TP are coupled to and counted by the counter 10 for the sequence control of the copy process. When a load or set signal $S_L$ supplied from an OR gate $G_1$ to the counter 10 is at a high level, the counter 10 will be enabled to be preset to a count input from a coder 20. When the load signal $S_L$ is at a low level, the counter 10 will operate in a count mode.

As is well known in the art, timing pulses TP are obtainable by a pulse generator 30 comprising the combination of a slotted disc rotatable in synchronism with a photosensitive or photoconductive drum 40 and a gap type photosensor (photointerrupter) located in a position which the slots of the disc will move past. A timing pulse TP therefore appears regularly every time a slot of the disc moves past the gap of the photosensor, or in synchronous relation with the rotation of the photosensitive drum 40.

A decoder 50 is connected to the presettable counter 10 and produces control output signals $STEP_1$–$STEP_n$ for sequence control in accordance with the count in the counter 10 which is a BCD signal.

All of the operations of the individual sections of the copying machine are controlled by the control output signals $STEP_1$–$STEP_n$ which the decoder 50 feeds to a microcomputer 60 in accordance with the count in the presettable counter 10. For instance, the control output signal $STEP_1$ may be delivered from the decoder 50 when the count in the counter 10 reaches "100" so as to drive an optical assembly for scanning a document. The control output signal $STEP_2$ may appear when the count reaches "300" so as to drive the optical assembly back to its home position. Likewise, the other control output signals $STEP_n$ may be produced at predetermined counts in the counter 10 to control corresponding operations.

In the illustrated circuit, the numbers of timing pulses TP counted by the counter 10 and the control output signals $STEP_1$–$STEP_n$ from the decoder 50 are so interrelated that sequence control can be performed for a copy process which uses B4 format sheets.

The decoder 50 supplies the coder 20 and an AND gate $G_2$ with a set output signal $S_{193}$ whose level becomes high when the count of the presettable counter 10 has a first value which is predetermined for a specific format of sheets used, e.g. "193" for A4 sheets or sheets smaller than A4 sheets in this embodiment. This value "193" ensures a travelling distance of the optical assembly which is necessary for copying images on A4 sheets. The decoder 50 couples to the coder 20 and an AND gate $G_3$ another set output signal $S_{266}$ which becomes high when the presettable counter 10 reaches a count "266" necessary for repeating the copying cycle.

In addition to the decoder set outputs $S_{193}$ and $S_{266}$, the coder 20 is supplied with a sheet size signal $S_{A4}$ and a repeat signal $S_R$ indicative of a repeat copy mode. At the instant the signal $S_{193}$ from the decoder 50 has become high, the coder 20 supplies the counter 10 with a signal which sets the count in the counter 10 to a second value which is predetermined for the format of sheets used, e.g. "216" for A4 sheets or sheets smaller than A4 sheets in this embodiment.

When a repeat signal $S_R$ is coupled to the coder 20 and a high level of the signal $S_{266}$ is also coupled thereto from the decoder 50, the decoder 50 produces a signal for loading the counter 10 with "63" which corresponds to a start point of a repeat copy sequence for A4 sheets or sheets smaller than A4 sheets when the A4 sheet size signal $S_{A4}$ is at a low level. When the signal $S_{A4}$ is at a high level, the coder 20 produces a signal for loading the counter 10 with "55" which corresponds to a start point of a repeat copy sequence for B4 sheets or sheets between A4 and B4.

The A4 sheet size signal $S_{A4}$ is a signal which is low in level when the sheets used have the format A4 or any format smaller than format A4 and is high when the sheets used have the format B4. This signal $S_{A4}$ is supplied through an inverter or any format between formats A4 and B4 $G_4$ to the AND gate $G_2$ in addition to the coder 20.

A differentiator 70 is designend to be triggered at trailing edges of the timing pulses TP so as to supply the AND gates $G_2$ and $G_3$ with a differentiated spike pulse.

Figure 2:
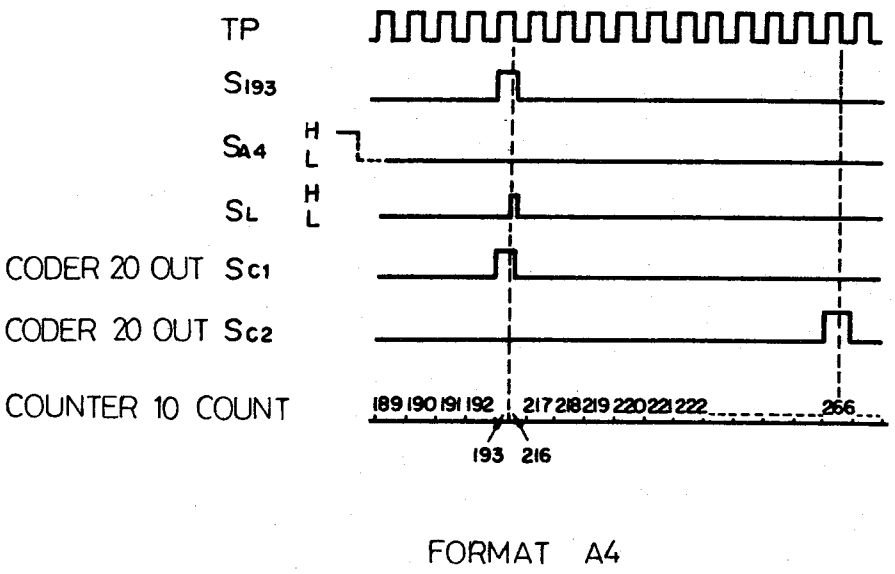
FIGS. 2 and 3 are timing diagrams illustrating the operation of the control circuit shown in FIG. 1.
Figure 3:
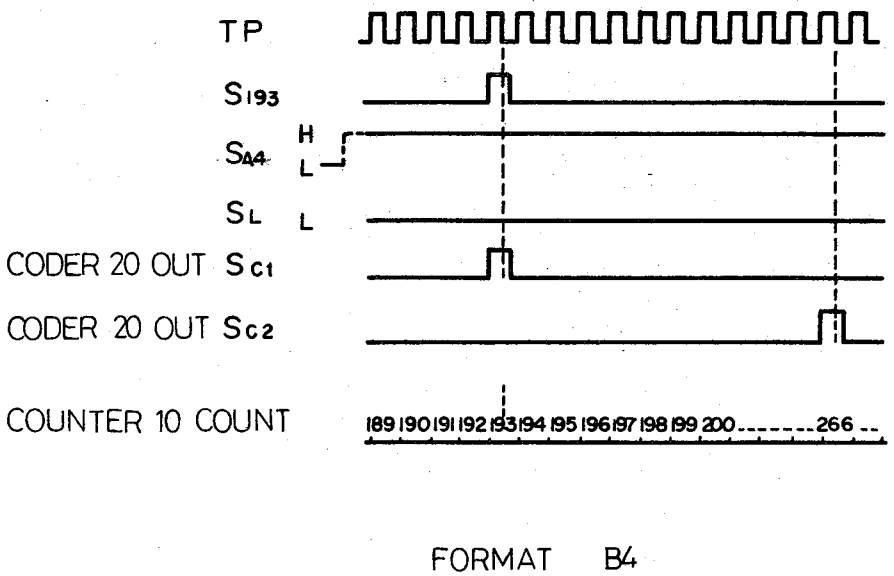

Referring also to FIGS. 2 and 3, hereinafter will be described the operation of the control circuit having the arrangement discussed above.

Suppose that transfer sheets to be used have the format A4 or any format smaller than the format A4. Upon depression of a print start switch (not shown), the A4 sheet size signal $S_{A4}$ becomes low or "L" as indicated in FIG. 2.

Timing pulses TP appear regularly as shown in FIG. 2 in synchronism with the rotation of the photosensitive drum 40. The presettable counter 10 counts up the successive timing pulses TP. Based on predetermined counts of the counter 10, the decoder 50 delivers control output signals $STEP_1$–$STEP_n$ at timings which are for the sequence control of a copy process for B4 sheets. Then, for example, an optical assembly will be driven for a forward stroke to scan a document.

When the presettable counter 10 reaches the predetermined count "193", the decoder 50 applies a high level set signal $S_{193}$ to the coder 20 and AND gate $G_2$ as viewed in FIG. 2.

In response to this signal $S_{193}$, the coder 20 supplies the counter 10 with a signal $S_{C1}$ for setting the count to "216" (shown in the form of one pulse for simplicity though it is a BCD signal in practice).

Meanwhile, the AND gate $G_2$ is supplied with the A4 sheet size signal $S_{A4}$ which has been inverted by the inverter $G_4$. Accordingly, the AND gate $G_2$ produces a high level output when the differentiator 70 is triggered by the trailing edge of the 193rd timing pulse TP to deliver a high level differentiated pulse. The high level output of the AND gate $G_2$ makes the load or set signal $S_L$ from the OR gate $G_1$ high as shown in FIG. 2.

At this instant, the counter 10 is enabled to take data thereinto from the coder 20 and thus changes its count from the first value "193" to the second value "216" at the trailing edge of the 193rd timing pulse TP as indicated in FIG. 2. Thereafter, the counter 10 counts the 194th pulse as "217" and keeps on counting the subsequent pulses. The decoder 50 continues its sequence control of the copy process on the basis of the counts of the counter 10.

More specifically, control output signals $STEP_1$–$STEP_n$ will be produced from the decoder 50 on the basis of the counts of the counter 10 and at the same timings as those for the sequence control of a copy process for B4 sheets.

However, since the count of the presettable counter 10 skips from "193" to "216" in the course of the sequence, the actual sequence is shorter than the sequence for B4 sheets by a time period necessary for producing 23 timing pulses. This is reflected by, for example, a decrease in the travelling distance of the optical assembly.

The skip from the count "193" to the count "216" is so determined as to skip a time which is not required for copying images on A4 sheets or sheets smaller than A4 sheets. Hence, a sequence control suited for A4 sheets or sheets smaller than A4 sheets can be carried out with the control program for B4 sheets.

The control circuit will operate as follows when the selected sheets have the format B4 or any format between formats A4 and B4.

In this case, the A4 sheet size signal $S_{A4}$ is high or "H" as shown in FIG. 3 while the inverter $G_4$ inverts this signal $S_{A4}$ and thereby delivers a low or "L" signal to one input terminal of the AND gate $G_2$. Accordingly, even when the decoder 50 supplies the AND gate $G_2$ with a high level signals $S_{193}$ as shown in FIG. 3 at the instant the count of the counter 10 has reached the first value "193", the output level of the AND gate $G_2$ remains low so that the load signal $S_L$ from the OR gate $G_1$ is kept low or "L".

Therefore, despite the fact that the coder 20 couples to the counter 10 the signal $S_{C1}$ for setting its count to the second value "216" as shown in FIG. 3, the counter 10 does not take in the data and holds the existing count. Upon arrival of the 194th timing pulse, the counter 10 advances its count from "193" to "194" without skipping.

In this way, when the selected sheets have the format B4 or any formats between formats A4 and B4, a sequence control for a copy process occurs in conformity with the B4 format. Stated another way, where sheets to be used have a format B4 or any formats between formats A4 and B4, the first and second predetermined values are equal to each other.

Concerning a repeat copy mode, the control circuit operates as will be described below. When the sheets used have the format A4, or the format smaller than the format A4, the coder 20 in response to the signal $S_{266}$ from the decoder 50 produces a signal which makes the count of the counter 10 "63".

When the differentiator 70 applies a high level differentiated pulse to the AND gate $G_3$ at the trailing edge of the 266th timing pulse TP, the AND gate $G_3$ supplies a high level output to the OR gate $G_1$ whereby the load signal $S_L$ coupled from the OR gate $G_1$ to the counter 10 is made high.

This high level signal $S_L$ permits the counter 10 to take data from the coder 20 thereinto and change its count from "266" to "63".

Likewise, where the sheet selected format have the format B4 or any format between formats A4 and B4, the count of the counter 10 changes from "266" to "55" at the trailing edge of the 266th timing pulse TP.

It will thus be understood that, when sheets of format A4 or sheets of format smaller than format A4 are used, the next scanning step can be started at an earlier timing by setting the count at which the counter 10 is to start its repeatable operation larger than in the case of B4 sheets.

In any case, the sequence control of a copy process can be performed on the basis of the counts in the counter 10 and with a common control program. Where sheets used have the format A4 or the format smaller than the format A4, the counter 10 will skip some of its counts in the course of the sequence as has been described.

Alternatively, the second predetermined value may be made smaller than the first such that the counts of the presettable counter 10 partly overlap. This permits a copy process for B4 sheets to be controlled by a control program suited for A4 sheets.

Although the present invention has been shown and described in connection with a case wherein B4 and A4 sheets are processed with a sequence for B4 sheets, it will be apparent that it is applicable to other formats of sheets or to three or more kinds of sheet formats.

Figure 4:
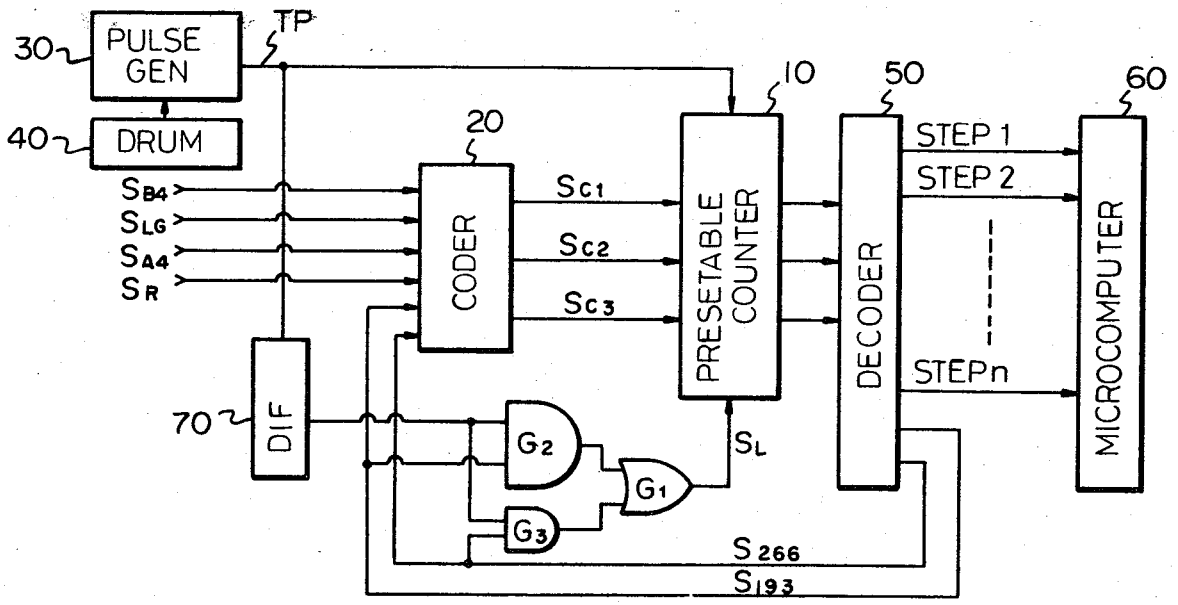
FIG. 4 is a block diagram of a modified control apparatus of the present invention.

Referring to FIG. 4, there is shown in block diagram form a modified control circuit of the present invention. The modified control circuit is designed for copying images not only on sheets of B4 and A4 formats but also on legal sheet format using a sequence for processing sheets of B4 format by way of example.

The modified control circuit is substantially similar to the control circuit as shown in FIG. 1 except that the inverter $G_4$ is omitted and that the coder 20 is supplied with a B4 sheet size signal $S_{B4}$ and a legal sheet size signal $S_{LG}$ in addition to the A4 sheet size signal $S_{A4}$.

Figure 5:
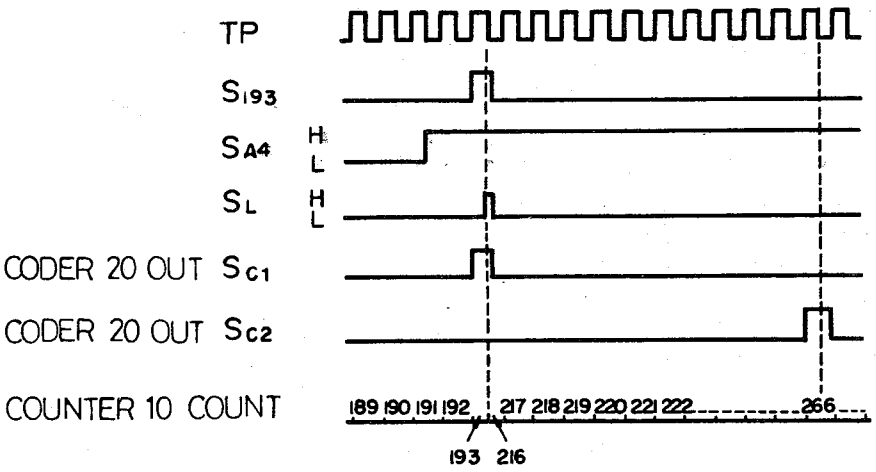
FIGS. 5 to 7 are timing diagrams illustrating the operation of the modified control apparatus shown in FIG. 4.
Figure 6:
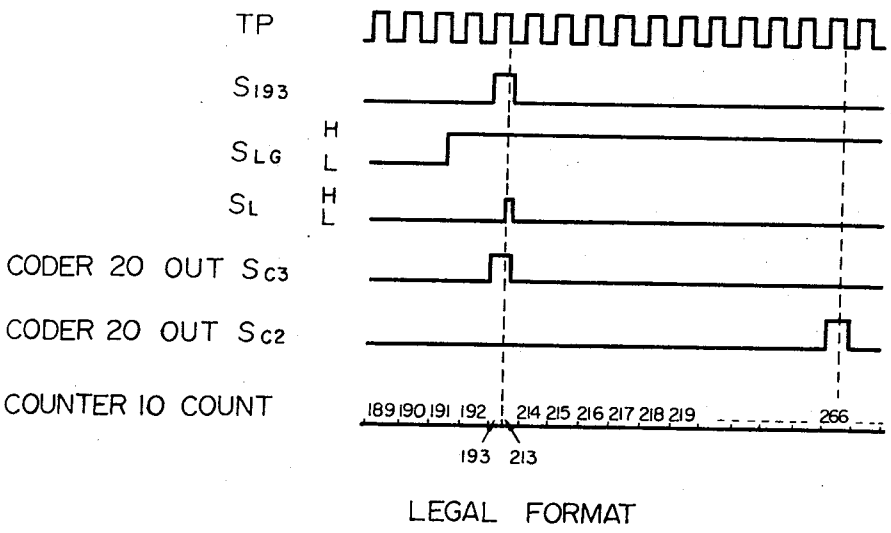
Figure 7:
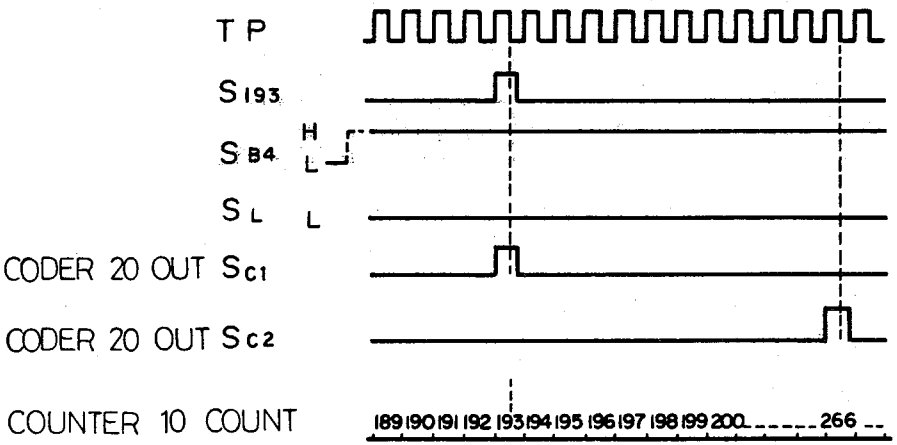

Referring also to FIGS. 5 to 7, hereinafter will be described that operation of the modified control circuit shown in FIG. 4.

Suppose that transfer sheets to be used have the format A4. Upon depression of the print start switch (not shown), the A4 sheet size signal $S_{A4}$ becomes high or "H" as indicated in FIG. 5.

Timing pulses TP appear regularly as shown in FIG. 5 in synchronism with the rotation of the photosensitive drum 40. The presettable counter 10 counts up the successive timing pulses TP. Based on predetermined counts of the counter 10, the decoder 50 delivers control output signals $STEP_1$–$STEP_n$ at timings which are for the sequence control of a copy process for B4 sheets. Then, for example, an optical assembly will be driven for a forward stroke to scan document.

When the presettable counter 10 reaches the predetermined count "193", the decoder 50 applies the high level set signal $S_{193}$ to the coder 20 and AND gate $G_2$ as viewed in FIG. 5.

In response to this signal $S_{193}$, the coder 20 supplies the counter 10 with the signal $S_{C1}$ for setting the count to "216". The AND gate $G_2$ produces a high level output when the differentiator 70 is triggered by the trailing edge of the 193rd timing pulse TP to deliver a high level differentiated pulse. The high level output of the AND gate $G_2$ makes the load or set signal $S_L$ from the OR gate $G_1$ high as shown in FIG. 5.

At this instant, the counter 10 is enabled to take data thereinto from the coder 20 and thus changes its count from the first value "193" to the second value "216" at the trailing edge of the 193rd timing pulse TP as indicated in FIG. 5. Thereafter, the counter 10 counts the 194th pulse as "217" and keeps on counting the subsequent pulses. The decoder 50 continues its sequence control of the copy process on the basis of the counts of the counter 10.

More specifically, control signals $STEP_1$–$STEP_n$ will be produced from the decoder 2 on the basis of the counts of the counter 1 and at the same timings as those for the sequence control of a copy process for B4 sheets.

FIG. 6 shows the operation of the modified control circuit shown in FIG. 4 when the selected sheets have the legal sheet format. In this case, when the counter 10 reaches the predetermined count "193", the decoder 50 applies the high level set signal $S_{193}$ to the coder 20 and AND gate $G_2$ as viewed in FIG. 6.

In response to this signal $S_{193}$, the coder 20 supplies the counter 10 with a signal $S_{C3}$ for setting the count to "213". The AND gate $G_2$ produces a high level output when the differentiator 70 is triggered by the trailing edge of the 193rd timing pulse TP to deliver a high level differentiated pulse. The high level output of the AND gate $G_2$ makes the load or set signal $S_L$ from the OR gate $G_1$ high as shown in FIG. 6.

At this instant, the counter 10 is enabled to take data thereinto from the coder 20 and thus changes its count from the first value "193" to the second value "213" at the trailing edge of the 193rd timing pulse TP as indicated in FIG. 6. Thereafter, the counter 10 counts the 194th pulses as "214" and keeps on counting the subsequent pulses. The decoder 50 continues its sequence control of the copy process on the basis of the counts of the counter 10.

More specifically, control signals $STEP_1$–$STEP_n$ will be produced from the decoder 2 on the basis of the counts of the counter 1 and at the same timings as those for the seuquence control of a copy process for B4 sheets.

FIG. 7 shows the operation of the modified control circuit shown in FIG. 4 when the selected sheets have the format B4. In this case, the B4 sheet size signal $S_{B4}$ is high or "H" and the load signal $S_L$ of the OR gate $G_1$ is kept low or "L" as shown in FIG. 7.

Therefore, despite the fact that the coder 20 couples to the counter 10 the signal $S_{C1}$ or $S_{C3}$ for setting its count to the value "216" or "213" as shown in FIG. 7, the counter 10 does not take in the data and holds the existing count. Upon arrival of the 194th timing pulse, the counter 10 advances its count from "193" to "194" without skipping.

Concerning a repeat copy mode, the modified control circuit shown in FIG. 4 operates as will be described below. Where the sheets used have the format A4, the coder 20 in response to the signal $S_{266}$ from the decoder 50 produces the signal $S_{C2}$ which makes the count of the counter 10 "63".

When the differentiator 70 applies a high level differentiated pulse to the AND gate $G_3$ at the trailing edge of the 266th timing pulse TP, the AND gate $G_3$ supplies a high level output to the OR gate $G_1$ whereby the load signal $S_L$ coupled from the OR gate $G_1$ to the counter 10 is made high.

This high level signal $S_L$ permits the counter 10 to take data from the coder 20 thereinto and change its count from "266" to "63".

Where the selected sheets have the legal sheet format, the count of the counter 10 changes from "266" to "61" at the trailing edge of the 266th timing pulse TP.

Likewise, where the selected sheets have the format B4 or any format between formats A4 and B4, the count of the counter 10 changes from "266" to 37 55" at the trailing edge of the 266th timing pulse TP.

In summary, a copying machine control method according to the present invention causes the counts of timing pulses to be partly skipped or overlapped in accordance with the size of selected transfer sheets. Thus, with this method, a single control program and a single timing control section suffice for the sequence control of a copy process suited to different formats of transfer sheets. This provides a decrease in the copying time and a reduction in cost. Various modifications will become possible for those skilled in the art after receiving the teachings of the present disclosure without departing from the scope thereof.

What is claimed is:

1. A copying machine control apparatus comprising:

a moving photoconductive member;

pulse generator means for producing pulses in response to incremental movements of the photoconductive member;

presettable counter means for counting the pulses;

decoder means for producing set output signals in response to counts in the counter means;

coder means responsive to the set output signals produced by the decoder means constructed to apply a first output signal to the counter means when the count in the counter means has a first value and apply a second output signal to the counter means when the count in the counter means has a second value, said counter means being constructed to change its count from the first value to a third value in response to the first output signal and to change its count from the second value to a fourth value in response to the second output signal from the coder means;

the decoder means being further constructed to produce control output signals in response to predetermined counts in the counter means; and copy operation control means for controlling an operation of the apparatus in response to the control output signals from the decoder means.

2. A copying machine control apparatus as claimed in claim 1, in which said first value is smaller than the third value.

3. A copying machine control apparatus as claimed in claim 1, in which said first value is greater than the third value.

4. A copying machine control apparatus as claimed in claim 1, in which the coder means is further constructed to apply a third output signal to the counter means when the count in the counter means has a fifth value, the counter means being further constructed to change its count from the fifth value to a sixth value.

5. A copying machine control apparatus as claimed in claim 4, in which the fifth value is equal to the first value.

6. A copying machine control apparatus as claimed in claim 4, in which the fifth value is smaller than the sixth value.

7. A copying machine control apparatus as claimed in claim 4, in which the fifth value is greater than the sixth value.

8. A copying machine control apparatus as claimed in claim 1, in which the photoconductive member is a rotary drum.

* * * * *